US007030722B2

(12) United States Patent
Yu et al.

(10) Patent No.: US 7,030,722 B2
(45) Date of Patent: Apr. 18, 2006

(54) HIGH-TEMPERATURE SHUTDOWN PROTECTING RELAY

(75) Inventors: Fang Yu, 1-24C., Lane 600, Liuzhou Road, Shanghai (CN); Jianhua Han, No.1, Lane 730, Beiqing Road, Shanghai (CN); Yinxiang Wang, Shanghai (CN)

(73) Assignees: Fang Yu, (CN); Jianhua Han, (CN)

( * ) Notice: Subject to any disclaimer, the term of this patent is extended or adjusted under 35 U.S.C. 154(b) by 0 days.

(21) Appl. No.: 11/199,288

(22) Filed: Aug. 8, 2005

(65) Prior Publication Data

US 2006/0055492 A1 Mar. 16, 2006

(30) Foreign Application Priority Data

Sep. 16, 2004 (CN) ..... 200420090165 U
Apr. 5, 2005 (CN) ..... 200520016262 U

(51) Int. Cl.
*H01H 75/00* (2006.01)

(52) U.S. Cl. ..... 335/6; 335/15; 335/21; 335/78; 335/156; 335/185; 335/192

(58) Field of Classification Search ..... 335/6, 335/8, 11, 14, 15, 21, 78, 83, 127, 129, 133, 335/156, 185, 189, 192, 194; 200/6 R, 8 R, 200/250, 271, 272

See application file for complete search history.

*Primary Examiner*—Ramon M. Barrera
(74) *Attorney, Agent, or Firm*—Ostrolenk, Faber, Gerb & Soffen, LLP

(57) ABSTRACT

A high-temperature shutdown protecting relay comprises a base; a L copper pin and a N copper pin are provided on the base with resting contacts provided at their bottoms respectively; stretchy copper blades are provided on the base, which are fit to the L copper pin and the N copper pin respectively, with movable contacts provided thereon, which are fit to said resting contacts; a stand is provided on the base and above the stretchy copper blades; grooves are provided on the lower side of the stand with ceramic rods for insulating the stand from the stretchy copper blades embedded therein. The high-temperature shutdown protecting relay provided by the present utility model can keep normal operating property under high temperature. When the movable contacts and the resting contacts are engaged with each other, a larger locking force can be kept therebetween; when the movable contacts and the resting contacts are disengaged, there is a larger disengaging force to ensure these two kinds of contacts disengaged, and to ensure a certain disengaging interval therebetween and very quick disengaging time.

8 Claims, 2 Drawing Sheets

HIGH-TEMPERATURE SHUTDOWN PROTECTING RELAY

TECHNICAL FIELD

The present utility relates to a high-temperature shutdown protecting relay, more specifically, to a shutdown protecting relay necessary to a mobile-protected electrical equipment.

BACKGROUND ART

Shutdown protecting relay is a component necessary to a mobile-protected electrical equipment, its main function is to ensure that the movable contacts and resting contacts of the mobile-protected electrical equipment, which carry electric current, can be engaged and disengaged quickly and reliably when power supply is on. Owing to the requirement of the power of electrical equipment, movable contacts and resting contacts of the mobile-protected electrical equipment must carry a larger current, so that the shutdown protecting relay must have the higher properties as follows:

1. when a mobile-protecting circuit is closed, that is, the movable contacts and the resting contacts are engaged with each other, a larger locking force must be kept between these two kinds of contacts;
2. when the mobile-protecting circuit is opened, that is, the movable contacts and the resting contacts are disengaged, a larger disengaging force is necessary to ensure the movable contacts and the resting contacts separated and to ensure a certain disengaging interval therebetween, meanwhile, the disengaging time must be very short;

But above-mentioned two requirements are contradictory with each other.

For a mobile-protected electrical equipment, owing to limitation of its properties, the larger disengaging force and the quicker disengaging time must be emphasized first, therefore, for a sufficient locking force between the movable contacts and the resting contacts, a hidden peril has ever existed; in addition, most of components of shutdown protecting relay of the prior art are made of engineering plastics, the larger the current carried and the longer the power supply is on, the poorer the high-temperature performance of the shutdown protecting relay, which finally causes the shutdown protecting relay to be in failure, the equipment to be burnt-out, extremely results in the disastrous events such as arc fire and electroshock injury.

SUMMARY OF THE INVENTION

The object of the present utility is to provide a high-temperature shutdown protecting relay having higher high-temperature performance to keep normal operation in a condition of high temperature. When movable contacts and resting contacts are engaged with each other, a larger locking force can be kept between these two kinds of contacts; when the movable contacts and the resting contacts are disengaged from each other, there is a larger disengaging force to ensure these two kinds of contacts disengaged, and to ensure a certain disengaging interval therebetween and very quick disengaging time.

To achieve the above object, the high-temperature shutdown protecting relay of the present utility comprises:

a base;

a L copper pin and a N copper pin provided on the base with resting contacts provided at their bottoms respectively;

stretchy (bouncing) copper blades provided on the base, which are fit to the L copper pin and the N copper pin respectively, with movable contacts provided thereon, which are fit to said resting contacts;

characterized in that a stand is provided on the base and above the stretchy copper blades;

grooves are provided on the lower side of the stand with ceramic rods for insulating the stand from the stretchy copper blades embedded therein.

In this way, when the power supply is on, the resting contacts and the movable contacts are engaged with each other, the temperature rises, and the heat causing the temperature to rise will be conducted to the stand via the stretchy copper blades, but the ceramic rods, which are made of a fireproof material and have more than 1000 degrees high-temperature performance, prevent the stand from contacting directly with the stretchy copper blades, therefore, the failure of the shutdown protecting relay resulting from temperature rise of the contacts can be prevented, thereby to prevent the whole mobile-protecting circuit from being burnt-out, and extremely to prevent the disastrous events such as arc fire and electroshock injury from occurring.

The present utility comprises further a first pushing pole with a circle end. The base comprises a wiring board with a through-hole which is fit to the circle end of the pushing pole to pass through. The first pushing pole has an intermediate part with square shape, so that it can pass through the through-hole until its square intermediate part reaches the hole to stop its passing. A first spring is provided over the first pushing pole, which presses the first pushing pole to move down until the square intermediate part of the pushing pole reaches the through-hole to stop its moving when the pushing pole passes through the hole.

A recess is provided in the intermediate part of the first pushing pole, which is fit to shape of a buckle piece.

A slot is provided on the buckle piece, a through-hole is provided in the stand, and a neck part of a second pulling pole passes through the through-hole of the stand to engage with the buckle piece. The shutdown protecting relay comprises an electromagnet coil and a second spring; an internal hole is provided in the electromagnet coil; and the second spring is fit together with the second pulling pole into the internal hole of the electromagnet coil. In this way, under the elastic force of the second spring, the buckle piece and the second pulling pole tends to turn around the through-hole of the stand in a small range until the square intermediate part of the first pushing pole reaches the through-hole of the wiring board to stop its moving when the first pushing pole passes through the hole.

Orthogonal turning corners are provided under the L copper pin and the N copper pin respectively, and the stand is provided under the orthogonal turning corners. Under the action of the elastic force of the stretchy copper blades, the movable contacts tend to be disengaged from the resting contacts until the ceramic rods and the stand are blocked at the turning corners of the L copper pin and the N copper pin to stop their moving when they are driven to move upward by the stretchy copper blades which are moving upward.

In this way, when the power supply is on, under the action of an external force, the buckle piece is embedded in the recess of the first pushing pole while the first pushing pole moves in the direction opposite to that of the elastic force of the first spring; and when the external force is removed, the stand will be integrated with the first pushing pole via the connection by the buckle piece and move downward together under the action of the first spring, which transmits the elastic force of the first spring through the first pushing pole, the buckle piece, the stand, the ceramic rods and the stretchy copper blades to between the movable contacts and the resting contacts until these two kinds of contacts are fully engaged, ensuring the larger locking force necessary to keep their engagement.

Once the circuit is opened, the electromagnet coil will produce an instantaneous "on" signal, so that there is a strong electromagnet field in the electromagnet coil. At this time, under the action of the electromagnet force, the second pulling pole will move backward, resulting in that the buckle piece is pulled to leave the position of the recess on the pushing pole and the stand is separated from the pushing pole; afterwards, under the action of the elastic force of the stretchy copper blades, the ceramic rods and the stand will move upward until the movable contacts are disengaged from the resting contacts.

As seen from the above, in this utility, through transition of the ceramic rods and the stand, the horizontal motion of the electromagnet coil and the second pulling pole will control the vertical motion of the movable contacts, which causes the movable contacts engaged with and disengaged from the resting contacts, ensuring the larger locking force necessary to keep their engagement. In addition, when the movable contacts are disengaged from the resting contacts, there is a larger disengaging force to ensure these two kinds of contacts disengaged, and to ensure a certain disengaging interval therebetween and very quick disengaging time.

BRIEF DESCRIPTION OF ACCOMPANYING DRAWINGS

DESCRIPTION IN DETAIL OF THE PREFERRED EMBODIMENT

Now the preferred embodiment of the present utility will be described with reference to FIG. 1~FIG. 3.

Figure 1:
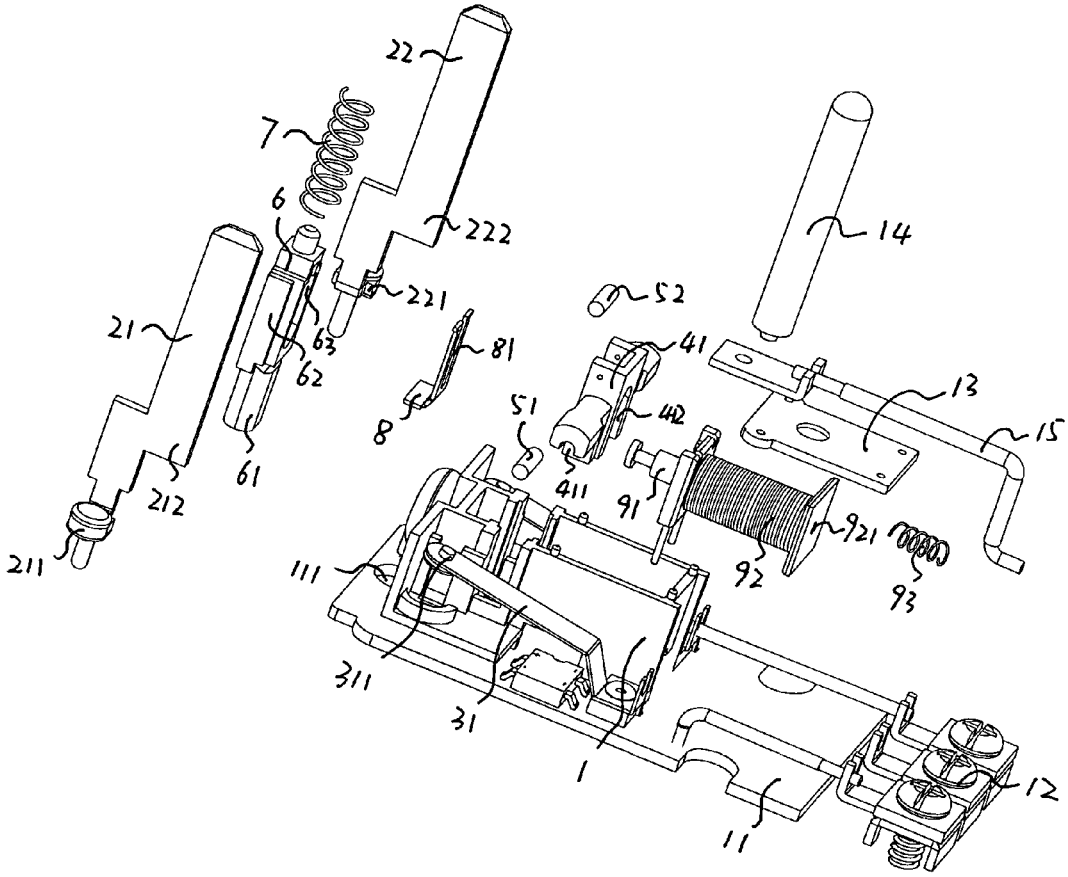
FIG. 1 is an exploded diagram of the present utility modes.
Figure 2:
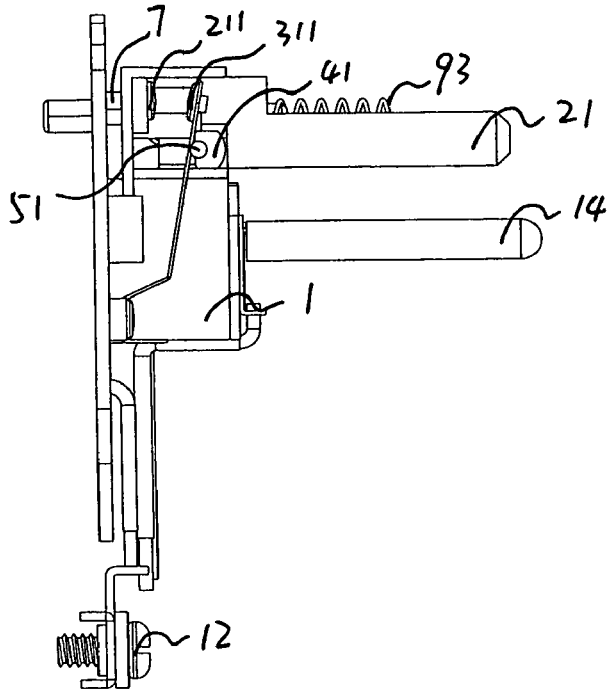
FIG. 2 is a front view of the present utility.

As shown in FIG. 1 being an exploded diagram of the present utility modes, the high-temperature shutdown protecting relay of the present utility comprises:

base 1;

L copper pin 21 and N copper pin 22 provided on the base with resting contacts 211 and 221 provided at the bottoms of L copper pin 21 and N copper pin 22 respectively;

stretchy copper blades 31, 32 (32 is not shown) provided on base 1, which are fit to L copper pin 21 and N copper pin 22 respectively, with movable contacts 311, 321 (321 is not shown) provided on stretchy copper blades 31, 32, which are fit to said resting contacts 211, 221;

stand 41 provided over stretchy copper blades 31, 32; grooves 411, 412 (412 is not shown) provided on the lower side of stand 41 with ceramic rods 51, 52 for insulating stand 41 from stretchy copper blades 31, 32 embedded therein.

When the power supply is on, resting contacts 211, 221 and movable contacts 311, 321 are engaged with each other, the temperature rises, the heat causing the temperature to rise is conducted to stand 41 via stretchy copper blades 31, 32, but ceramic rods 51, 52, which are made of a fireproof material and have more than 1000 degrees high-temperature performance, prevent stand 41 from contacting directly with stretchy copper blades 31, 32, therefore, failure of the shutdown protecting relay resulting from the temperature rise of the contacts can be prevented, thereby to prevent the whole mobile-protecting circuit from being burnt-out, and extremely to prevent the disastrous events such as arc fire and electroshock injury from occurring.

The present utility comprises further first pushing pole 6 with a circle end 61; base 1 comprises wiring board 11 with through-hole 111 which is fit to circle end 61 of pushing pole 6 to pass through; and connection terminals 12 are provided at the end of wiring board 11. First pushing pole 6 has an intermediate part 62 with a square shape, so that it can pass through through-hole 111 until its square intermediate part 62 reaches through-hole 111 to stop its passing. First spring 7 is provided over first pushing pole 6, which presses first pushing pole 6 to move down until square intermediate part 62 of pushing pole 6 reaches through-hole 111 to stop its moving when pushing pole 6 passes through the hole.

Recess 63 is provided in the intermediate part of the pushing pole, which is fit to shape of buckle piece 8.

Slot 81 is provided on buckle piece 8, through-hole 412 is provided in stand 41, and a neck part of second pulling pole 91 passes through through-hole 412 of the stand to engage with slot 81 of the buckle piece. The shutdown protecting relay comprises electromagnet coil 92 and second spring 93; internal hole 921 is provided in electromagnet coil 92; and second spring 93 is fit together with second pulling pole 91 into internal hole 921 of electromagnet coil 92. In this way, under the elastic force of second spring 93, buckle piece 8 and second pulling pole 91 tend to turn around through-hole 412 of the stand in a small range until square intermediate part 62 of first pushing pole 6 reaches through-hole 111 of the wiring board to stop its moving when it passes through through-hole 111.

Figure 3:
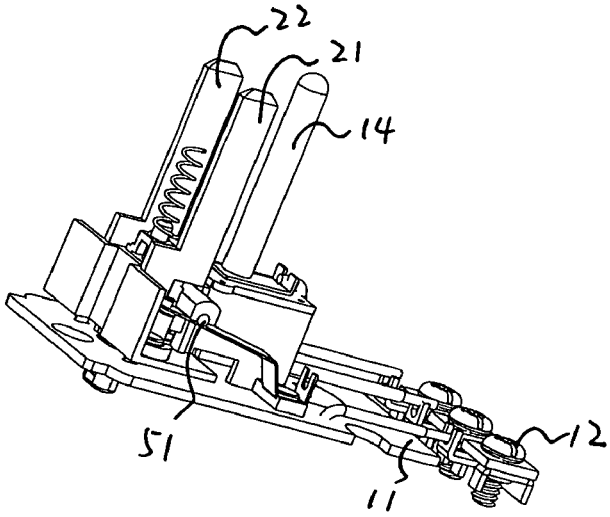
FIG. 3 is a perspective vies of the present utility.

Orthogonal turning corners 212, 222 are provided under L copper pin 21 and N copper pin 22 respectively, and stand 41 is provided under orthogonal turning corners 212, 222, as shown in FIG. 3. Under the action of the elastic force of stretchy copper blades 31, 32, movable contacts 311, 321 tend to be disengaged from resting contacts 211, 212 until ceramic rods 51, 52 and stand 41 are blocked at turning corners 212, 222 of the L copper pin and the N copper pin to stop their moving when they are driven to move upward by the stretchy copper blades 31, 32 which are moving upward.

In this way, when the power supply is on, under the action of an external force, buckle piece 8 is embedded in recess 63 of first pushing pole 6 while first pushing pole 6 moves in the direction opposite to that of the elastic force of first spring 7; and when the external force is removed, stand 41 will be integrated with first pushing pole 6 via the connection by buckle piece 8 and move downward together under the action of first spring 7, which transmits the elastic force of first spring 7 through first pushing pole 6, buckle piece 8, stand 41, ceramic rods 51, 52 and stretchy copper blades 31, 32 to between movable contact 311 and resting contact 211 as well as between movable contact 321 and resting contact 221 until these two kinds of contacts are fully engaged, ensuring the larger locking force necessary to keep their engagement.

Once the circuit is opened, electromagnet coil 92 will produce an instantaneous "on" signal, so that there is a strong electromagnet field in electromagnet coil 92. At this time, under the action of the electromagnet force, second pulling pole 91 will move backward, resulting in that buckle piece 8 is pulled to leave the position of recess 63 on pushing pole 6 and stand 41 is separated from pushing pole 6;

afterwards, under the action of the elastic force of stretchy copper blades 31, 32, ceramic rods 51, 52 and stand 41 will move upward until the movable contacts are disengaged from the resting contacts.

As seen from the above, in this utility, through transition of ceramic rods 51, 52 and stand 41, the horizontal motion of electromagnet coil 92 and second pulling pole 91 will control the vertical motion of movable contacts, which causes the movable contacts engaged with and disengaged from the resting contacts, ensuring the larger locking force necessary to keep their engagement. In addition, when the movable contacts are disengaged from the resting contacts, there is a larger disengaging force to ensure these two kinds of contacts disengaged, and to ensure a certain disengaging interval therebetween and very quick disengaging time.

In the present utility, stand 41, second pulling pole 91 and electromagnet coil 92 are provided in base 1 with cover plate 13 thereon. In the present utility, a whole shutdown protecting relay comprises further grounding pin 14 mounted through grounding piece 15 on cover plate 13. FIG. 2 is a front view of the present utility after assembled, and FIG. 3 is its perspective view.

What is claimed is:

1. A high-temperature shutdown protecting relay, comprising:

a base;

a L copper pin and a N copper pin provided on the base with resting contacts provided at their bottoms respectively;

stretchy copper blades provided on the base, which are fit to the L copper pin and the N copper pin respectively, with movable contacts provided thereon, which are fit to said resting contacts;

wherein a stand is provided on the base and above the stretchy copper blades;

grooves are provided on the lower side of the stand with ceramic rods for insulating the stand from the stretchy copper blades embedded therein.

2. The high-temperature shutdown protecting relay of claim 1, comprising further a first pushing pole with a substantially circle end;

wherein the base comprises a wiring board with a through-hole which is fit to the circle end of the pushing pole to pass through; the first pushing pole has an intermediate part with square shape, so that the first pushing pole can pass through the through-hole until its square intermediate part reaches the hole to stop its passing;

a first spring is provided over the first pushing pole, which presses the first pushing pole to move down until the square intermediate part of the pushing pole reaches the through-hole to stop its moving when the pushing pole passes through the hole.

3. The high-temperature shutdown protecting relay of claim 2, wherein a recess is provided in the intermediate part of the first pushing pole, the recess is fit to shape of a buckle piece as one of components.

4. The high-temperature shutdown protecting relay of claim 3, wherein a slot is provided on the buckle piece, a through-hole is provided in the stand, and a neck part of a second pulling pole passes through the through-hole of the stand to engage with the slot of the buckle piece, the shutdown protecting relay comprises an electromagnet coil and a second spring, an internal hole is provided in the electromagnet coil, and the second spring is fit together with the second pulling pole into the internal hole of the electromagnet coil.

5. The high-temperature shutdown protecting relay of claim 4, wherein orthogonal turning corners are provided under the L copper pin and the N copper pin respectively, and the stand is provided under the orthogonal turning corners.

6. The high-temperature shutdown protecting relay of claim 5, wherein under the action of the elastic force of the stretchy copper blades, the movable contacts tend to be disengaged from the resting contacts until the ceramic rods and the stand are blocked at the turning corners of the L copper pin and the N copper pin to stop their moving when they are driven to move upward by the stretchy copper blades which are moving upward.

7. The high-temperature shutdown protecting relay of claim 6, wherein when the power supply is on, under the action of an external force, the buckle piece is embedded in the recess of the first pushing pole while the first pushing pole moves in the direction opposite to that of the elastic force of the first spring; and when the external force is removed, the stand will be integrated with the first pushing pole via the connection by the buckle piece and move downward together under the action of the first spring, which transmits the elastic force of the first spring through the first pushing pole, the buckle piece, the stand, the ceramic rods and the stretchy copper blades to between the movable contacts and the resting contacts until these two kinds of contacts are fully engaged.

8. The high-temperature shutdown protecting relay of claim 6, wherein once the circuit is opened, the electromagnet coil will produce an instantaneous "on" signal, so that there is a strong electromagnet field in the electromagnet coil; under the action of the electromagnet force, the second pulling pole will move backward, resulting in that the buckle piece is pulled to leave the position of the recess on the pushing pole and the stand is separated from the pushing pole; afterwards, under the action of the elastic force of the stretchy copper blades, the ceramic rods and the stand will move upward until the movable contacts are disengaged from the resting contacts.

* * * * *